US006458316B1

(12) United States Patent
Garrett

(10) Patent No.: US 6,458,316 B1
(45) **Date of Patent: *Oct. 1, 2002**

(54) RETICULATED FOAM STRUCTURES

(75) Inventor: Michael E. Garrett, Woking (GB)

(73) Assignee: The BOC Group plc, Windlesham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/500,678

(22) Filed: Feb. 9, 2000

(30) Foreign Application Priority Data

Feb. 12, 1999 (GB) ..... 9903276

(51) Int. Cl.[7] ..... B22F 3/10
(52) U.S. Cl. ..... 419/2; 419/26
(58) Field of Search ..... 419/2, 26

(56) References Cited

U.S. PATENT DOCUMENTS 3,847,591 A * 11/1974 Niebylski et al. ..... 75/20 F
4,099,961 A * 7/1978 Patten ..... 75/20 F
4,614,544 A 9/1986 Lall
5,151,246 A * 9/1992 Baumeister et al. ..... 419/2

FOREIGN PATENT DOCUMENTS

DE 4018360 5/1991

OTHER PUBLICATIONS

ASM Handbook, vol. 4, Heat Treatment, pp 67, 851–853, 1991.*

* cited by examiner

*Primary Examiner*—Daniel J. Jenkins
(74) *Attorney, Agent, or Firm*—Joshua L. Cohen; Salvatore P. Pace

(57) ABSTRACT

A metal foam object results from the mixing of a gasifier with metal powder and subjecting the mixture to an elevated temperature $T_1$ and pressure $P_1$ to form a sintered sheet placing at least a portion of the sintered sheet into a mold and subjecting the mold to a temperature $T_2$ where $T_2$ is greater than $T_1$ at which the metal melts and the gas is released from the gasifier and quenching the metal foam object thus formed in the mold. The quenching is carried out by applying a cryogen to the object as a high velocity mixture of gas and liquid droplets.

4 Claims, 1 Drawing Sheet

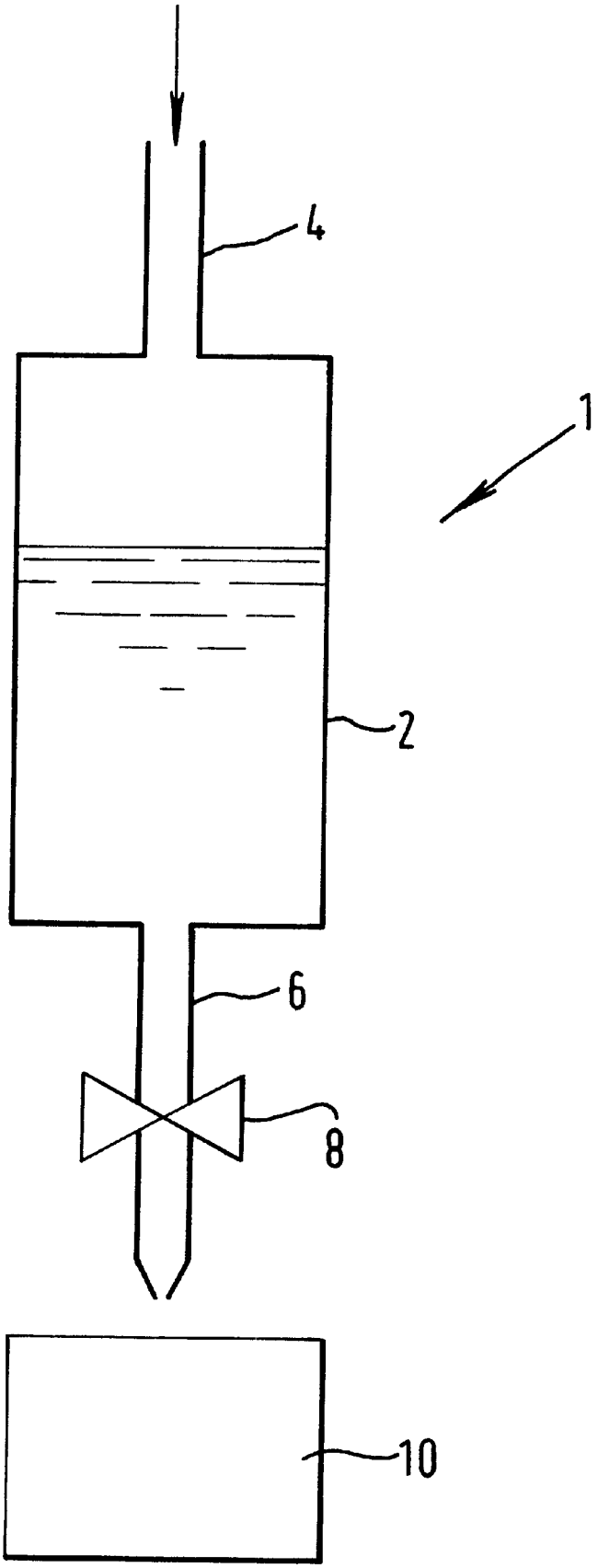
4
1
2
6
8
10

RETICULATED FOAM STRUCTURES

BACKGROUND OF THE INVENTION

Foam structures are known in industry and the number of applications for metallic foam structures is continually increasing. For example, aluminium foam metal having a continuously connected, open celled (reticulated) geometry is available and employed as energy and impact absorbers; in heat exchangers and as lightweight composite panels.

When used with heat exchanges the high surface to volume ratio allows for a compact design and the high specific stiffness, that is, high strength to weight ratio makes the material useful in aerospace and car applications.

Low-cost aluminium foam panels can be produced by a continuous casting process. The foam is machinable by common aluminium metal working techniques (sawing, drilling, milling) and may be joined by brazing or adhesive bonding. As previously indicated aluminium foam produced by this method finds application as lightweight cores for sandwich panels and as components in energy absorbing structures.

When irregular complex shapes are required, however, metal foams are formed typically by mixing small quantities of a gasifier e.g. titanium nitride with aluminium powder and subjecting the mixture to heat and pressure to form a sintered sheet.

The sintered sheet or a portion thereof is then placed in a mold which is then heated to a higher temperature at which the metal melts and nitrogen is released from the titanium nitride to provide an even dispersion of bubbles.

The hot metal is allowed to solidify and then is shock heat treated by dropping it into a cryogen such as liquid nitrogen which causes small fractures to occur between adjacent bubbles so that the mass becomes reticulated. This quenching process can be controlled by monitoring the temperature of the metal before it is quenched in the cryogen. The rate of cooling and the temperature difference, however, may still be insufficient to produce the necessary reticulated structure.

It is an aim of the present invention to add a further degree of control to the quenching process by employing the cryogen as a high velocity mixture of gas and liquid droplets.

BRIEF SUMMARY OF THE INVENTION

According to the present invention a method of making a metal foam object includes the steps of mixing a gasifier with metal powder and subjecting the mixture to an elevated temperature $T_1$ and pressure $P_1$ to form a sintered sheet; placing at least a portion of the sintered sheet in a mold and subjecting the mold to a temperature $T_2$ where $T_2$ is greater than $T_1$ at which the metal melts and the gas is released from the gasifier; and quenching the metal foam object thus formed by the mold in which the quenching is carried out by applying a cryogen to the object as a high velocity mixture of gas and liquid droplets.

Preferably the cryogen is nitrogen, the gasifier is titanium nitride and the metal is aluminium.

BRIEF DESCRIPTION OF THE DRAWINGS

The appended FIGURE is a block diagram of an apparatus for quenching objects according to the present invention. An embodiment of the invention will now be described, by way of example, reference being made to the accompanying diagrammatic drawing.

DETAILED DESCRIPTION OF THE PRESENT INVENTION

As shown in the FIGURE, the apparatus 1 includes a heat insulated pressure vessel 2 containing a cryogen, for example, liquid nitrogen. An inlet pipe 4 is in communication with the ullage space at the top of the liquid cryogen and an outlet pipe 6 is located at or adjacent the base of the vessel 2 as illustrated. The flow of liquid/gas from the vessel 2 and through the pipe 6 is controlled by a valve 8.

In use, the vessel 2, is pressurized to approximately 5 bar by passing a gas through the inlet pipe 4 and the liquid cryogen is then expanded through the valve 8 and the outlet pipe assembly 6 such that a high velocity mixture of gas and liquid droplets impinges upon the object 10 to be quenched.

The high velocity gas liquid droplet stream will extract heat from the block 10 many times faster than dipping the object 10 in liquid nitrogen since the film boiling effect which prevents the liquid nitrogen from touching the block is avoided.

Conventional ways of achieving high heat transfer with liquid nitrogen involves the use of a low thermal conductivity coating such as a grease which enables the liquid nitrogen to wet the surface of the object without an intervening gas film being formed. However, this is impractical with very hot metals and the filmboiling effect is aggravated resulting in lower and unpredictable heat transfer. The use of a high velocity gas and a liquid droplet stream can be finely controlled by pressure and valve openings to give the optimum cooling rate.

While an embodiment of the present invention has been described in detail, it is apparent that further modifications and adaptations of the invention will occur to those skilled in the art. However, it is to be expressly understood that such modifications and adaptations are within the spirit and scope of the invention.

What is claimed is:

1. A method of making a metal foam object comprising the steps of:

mixing a gasifier with metal powder and subjecting the mixture to an elevated temperature $T_1$ and pressure $P_1$ to form a sintered sheet;

placing at least a portion of the sintered sheet into a mold and subjecting the mold to a temperature $T_2$ where $T_2$ is greater than $T_1$ at which the metal melts and a gas is released from the gasifier forming a metal foam object;

pressurizing a cryogen with a gas for providing a cryogen mixture of gas and liquid droplets for application to the metal foam object; and impinging the metal foam object with the cryogen mixture applied under pressure as a stream of gas and liquid droplets.

2. The method of claim 1 wherein the cryogen is nitrogen.

3. The method of claim 1 wherein the gasifier is titanium nitride and the metal is aluminium.

4. The method of claim 1 further comprising the step of: controlling a velocity of the mixture to provide a rate of cooling for the metal foam object.

* * * * *